United States Patent [19]

Hurst

[11] Patent Number: 4,827,188

[45] Date of Patent: May 2, 1989

[54] HYDROGEN GETTER AND METHOD OF MANUFACTURE

[75] Inventor: Derek P. Hurst, Loughborough, England

[73] Assignee: Thorn EMI plc, London, England

[21] Appl. No.: 101,267

[22] Filed: Sep. 25, 1987

[30] Foreign Application Priority Data

Sep. 27, 1986 [GB] United Kingdom ..... 8623296

[51] Int. Cl.[4] ..... H01J 17/24; H01J 61/26

[52] U.S. Cl. ..... 313/559; 313/558; 313/560; 313/561; 313/562

[58] Field of Search ..... 313/559, 549, 558, 560, 313/561, 562; 252/181.5, 181.6; 417/48; 445/53, 55

[56] References Cited

U.S. PATENT DOCUMENTS

| | | | |
|---|---|---|---|
| 2,951,172 | 8/1960 | Griffiths, Jr. et al. | 313/559 X |
| 3,081,413 | 3/1963 | Cummings | 313/558 X |
| 3,519,864 | 7/1970 | Gungle et al. | 313/560 X |
| 3,737,709 | 6/1973 | Hornmann et al. | 313/561 X |
| 3,953,755 | 4/1976 | Kuus et al. | 313/561 |
| 4,117,369 | 9/1978 | Kuus et al. | 313/559 |

FOREIGN PATENT DOCUMENTS

| | | | |
|---|---|---|---|
| 119082 | 9/1984 | European Pat. Off. | 313/558 |
| 1484586 | 9/1977 | United Kingdom . | |
| 2125615 | 3/1984 | United Kingdom . | |

OTHER PUBLICATIONS

Kuus; Selective Gettering of Hydrogen in High Pressure Metal Iodide Lamps; May/Jun. 76; (728–733).

Kuus; A Getter for Metal Iodide High Pressure Mercury Vapor Lamps; 1975; (354–355).

*Primary Examiner*—David K. Moore

*Assistant Examiner*—Michael Horabik

*Attorney, Agent, or Firm*—Fleit, Jacobson, Cohn & Price

[57] ABSTRACT

A hydrogen getter for use within the arc tube assembly of a gas discharge lamp e.g. a high pressure sodium discharge lamp, comprises a layer (11) of a getter material (eg Ti) sandwiched by diffusion bonding between layers (12, 13) of a hydrogen permeable material (eg Nb) there being an exposed region of getter material. Hydrogen getters in the form of disc-like washers are formed from the sandwiched layers by a stamping process.

5 Claims, 1 Drawing Sheet

HYDROGEN GETTER AND METHOD OF MANUFACTURE

This invention relates to the production of hydrogen getters suitable for use in the arc tube assembly of a gas discharge lamp e.g. a high pressure sodium discharge lamp. More particularly the invention is concerned with the use of titanium as a hydrogen getter in high pressure sodium discharge lamps; the titanium having a protective covering of hydrogen permeable material, for example, niobium, to prevent the titanium from attack by the sodium vapours of the discharge. Sodium attack reduces the ability of the getter material to getter hydrogen, the presence of which increases the lamp operating voltage (Vt); increases the time for voltage stabilisation; increases the starting voltage and generally lowers the efficiency of the lamp. Sodium attack also causes an unacceptable lamp voltage rise during the life of the lamp.

Getters are known in which hydrogen gettering materials are covered by a hydrogen permeable material which can resist attack by sodium vapours. U.S. Pat. No. 4,117,369 discloses the use of hydrogen permeable metals, such as, tantalum, niobium, vanadium, nickel, iron alloys of at least two of these metals and alloys of at least one of the metals with tungsten or molybdenum. Hydrogen gettering materials which may be used are, scandium, yttrium, lanthanum, lanthanides and alloys thereof. In UK Pat. No. 1484586 there is disclosed a getter selected from one of the following getter materials, thorium, hafnium, zirconium, titanium, yttrium, lanthanum, and the lanthanides. The selected getter material is enclosed in a tantalum, molybdenum or tungsten capsule. In both these patents the getter comprises a cylindrical pellet of gettering material surrounded by the capsule, part of which is made of hydrogen permeable material so that there is no direct exposure of the gettering material to the vapours of the discharge. Moreover, in both these patents the construction is somewhat complicated comprising a cylindrical housing which has to be evacuated and then closed by a cover part joined to the housing by resistance welding.

In our UK Pat. No. GB 2125615B we describe the use of a hydrogen getter in the form of a coil of titanium wire having a coating of niobium. The cut ends of this wire expose the titanium core which is, therefore, open to attack by the vapours of the sodium discharge. We have found, however, that coil getters manufactured according to our Pat. No. GB 2125615B operate satisfactorily despite the exposure of the titanium. It is believed that the surface area of titanium exposed which is 0.4 $mm^2$, is sufficiently small relative to the amount of titanium present so that an effective gettering action still takes place. Now, however, we have found that the exposed area can be as high as 2 sq mm and the getter will still perform satisfactorily even though this represents an increase of the order 500%.

According to the present invention there is provided a hydrogen getter comprising a layer of a getter material sandwiched between layers of a hydrogen permeable material, there being an exposed region of said getter material.

According to a further aspect of the present invention there is provided a method of producing a hydrogen getter including the steps of sandwiching a layer of a getter material between layers of a hydrogen permeable material so as to provide an exposed region of said getter material.

According to yet a further aspect of the present invention there is provided an electrode assembly for a high pressure sodium discharge lamp, the assembly comprising an end closure member for a discharge arc tube, the end closure member carrying an electrically conductive electrode supporting shank member and a hydrogen getter attached to the shank member, the getter being located closer to the end closure member than to the electrode.

In a preferred method according to the invention a layer of titanium metal is sandwiched between two layers of niobium by diffusion bonding and getter discs or washers are stamped out from the resulting getter sandwich. An important advantage of this is that it avoids the use of complicated coiling equipment which is necessary to produce getter coils in accordance with our aforementioned Pat. No. GB 2125615B. It also avoids the necessity to provide the fabricated housings of the aforementioned U.S. and UK patents.

The invention will now be described by way of example only and with reference to the accompanying drawings wherein.

Figure 3A:
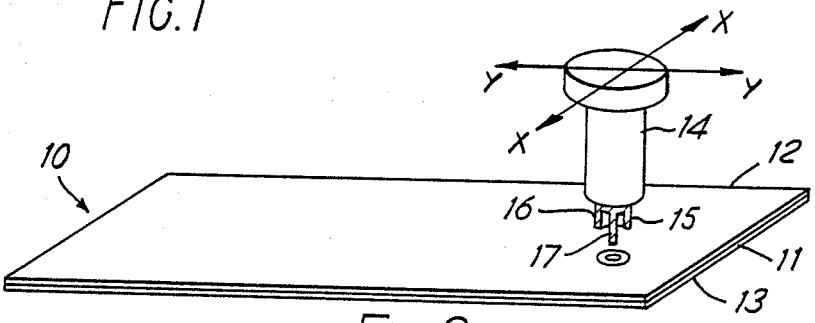
Figure 3B:
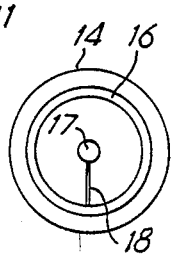
Figure 4:
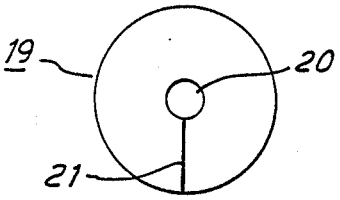

FIG. 3*a* illustrates diagrammatically an arrangement for producing getter washers by stamping from a titanium/niobium sandwich, FIG. 3*b* shows, on an enlarged scale, an end view of a die head used in the arrangement of FIG. 3*b*, FIG. 4 is a plan view of a getter washer in accordance with the invention.

Figure 5:
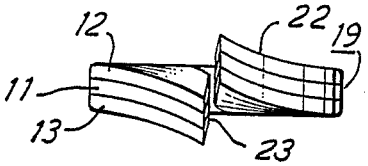

FIG. 5 is an end view of a getter washer in accordance with the invention.

Figure 6:
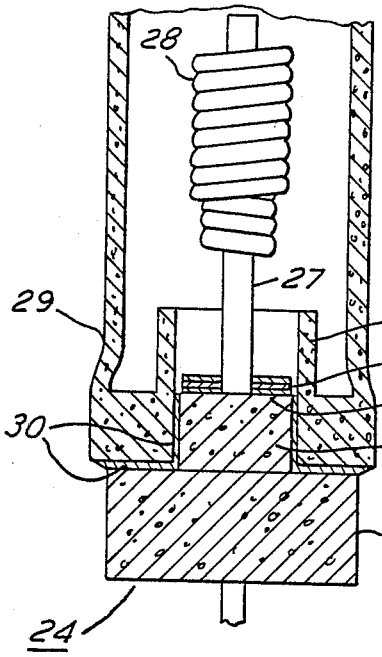

FIG. 6 shows an electrode assembly for a high pressure sodium discharge lamp incorporating a getter washer according to the invention.

Figure 1:
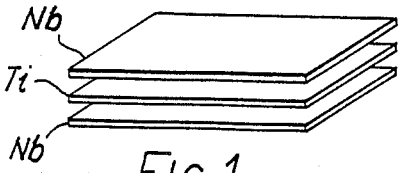
FIG. 1 is a perspective view of a sheet of titanium interposed between two sheets of niobium.
Figure 2:
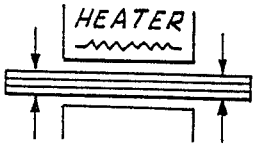
FIG. 2 is a diagrammatic representation of the sheets of FIG. 1 being "sandwiched" together.

FIG. 1 is a perspective view of a sheet of titanium interposed between two sheets of niobium. The sheets can be of any convenient size, for example, for forming a single getter "washer". However, preferably the sheets are of the order 400 mm×300 mm so that for production purposes a plurality of getter discs or washers can be produced from a single sandwich. The separate individual sheets are "sandwiched" together by any suitable method. FIG. 2 illustrates diagrammatically how individual sheets may be joined together by diffusion bonding. Initially, the sheets are cleaned thoroughly and degreased by application of a chemical solution. The sheets are then heated in an evacuated furnace to a temperature of about 1000° C. and a pressure of about 2MPa is applied. The diffusion bonding technique is preferred since it is relatively quick and the temperatures used are below the melting temperature of the constituent materials, titanium and niobium. The sandwich is then allowed to cool slowly preferably in an atmosphere of an inert gas such as argon. Other methods of "sandwiching" the sheets may be used, for example, they may be joined together by solder techniques but it is important that any joining material used must be inert to the lamp discharge otherwise the lamp may malfunction. The primary consideration is that the "sandwiched" material must not de-laminate during washer manufacture and lamp operation.

FIG. 3*a* illustrates diagrammatically how getter washers in accordance with the invention can be stamped out from a bonded sandwich 10 comprising a sheet 11 of titanium sandwiched between sheets 12 and 13 of niobium. Stamping is carried out using a stamping tool 14 which can be translated with respect to the sandwich in the X and Y directions, as shown, thereby allowing a number of washers to be cut from the same sandwich. The stamping tool has a two-stage die head 15 which is shown in cross-section in FIG. 3*a* and end-on in FIG. 3*b*. The die head comprises a cutting cylinder 16, a central prong 17 projecting beyond the cutting cylinder and a radially extending web 18 interconnecting the prong and the cylinder. In use, the stamping tool is lowered down onto the sandwich so that initially the prong punches a hole, followed closely by the cutting cylinder which cuts around the hole. At the same time, the web cuts a narrow slit in the formed washer. If desired the ends of the washer may be splayed apart as the final cuts are completed and this can be achieved in any known manner by providing a suitably shaped formation on the die head and or an associated jig. By way of example, FIGS. 4 and 5 show plan and side elevation views of a getter washer 19 produced in the above described manner. The getter washer illustrated in FIGS. 4 and 5 comprises a titanium layer 11 which is sandwiched between upper and lower niobium layers 12 and 13 respectively, (best seen in FIG. 5) joined by diffusion bonding as described above. The washer 19 has a central aperture 20 and is slit at 21 so that it can be conveniently fitted onto the shank of the electrode assembly of a discharge lamp. One cut end 22 of the washer is turned upwardly while the the other cut end 23 is turned downwardly as seen in FIG. 5. Because the material has been cooled slowly it is very ductile allowing the cut ends 22 and 23 to be splayed apart readily and enabling the washer to be slid onto the shank of a discharge electrode. It is helpful if the central hole of the washer is made slightly undersize and, in a typical example, the washer has an overall diameter of 3.85 mm with a bore of 1.11 mm. The niobium layers may each have a thickness of 0.025 mm and the thickness of the titanium layer may be about 0.075 mm, the exposed region of the titanium layer, in this case, being 1.37 mm long representing 5% of the surface area of the washer. In a typical application, for example a 400 watt high pressure sodium discharge lamp, a getter washer having a titanium content of 4 mg was necessary to ensure satisfactory operation of the lamp. It should be noted, though, that the amount of titanium required is very much dependent on individual lamp specifications and the actual processing of lamp materials since this, to a large extent, determines the impurities which have to be gettered.

It will be understood that although the described hydrogen getter uses titanium as a gettering material, other materials such as titanium/niobium alloy, zirconium, yttrium, scandium and alloys of zirconium, yttrium and scandium could be used.

In FIG. 6 there is shown an electrode assembly 24 for a 400 Watt high pressure sodium discharge lamp. The electrode assembly 24 is made up of an electrically conducting cermet end closure member 25 having a boss 26 in which is embedded one end of electrode shank 27. The other end of the electrode shank carries electrode 28. The electrode assembly 24 is fitted within a polycrystalline alumina arc tube 29 by means of a suitable sealing material 30. The alumina arc tube 29 is formed with an integral shoulder member 31 which effectively prevents rectification during start-up of the lamp and subsequent operation. A getter washer 19, as described above, is positioned on the electrode shank 27 adjacent end face 32 of boss 26. The resilience imparted by sprung ends 22, 23 effectively maintains the getter washer in position on the lower end of the electrode shank or in contact with the end face 32 in which case the end closure member 25 can, to some extent, act as a heatsink. The temperature differential along the electrode shank can be relatively large, for example, as high as 1,000°-1100° C. at the bottom end of the electrode 27 dropping to 700°-850° C. at the cermet face 32 and since the rate of sodium attack is very much temperature dependent it is desirable that the getter be located at the coolest region of the exposed shank. In addition the getter washer 19 has additional protection from the discharge by being placed within shoulder member 31. It is within the scope of the present invention that a getter disc as described herein may be located within the arc tube and maintained in a preselected position, for example, by welding.

High pressure sodium discharge lamps incorporating hydrogen getters in accordance with present invention have been life tested and their operation has been found satisfactory.

I claim:

1. A gas discharge lamp comprises a discharge arc tube having a fill including sodium and a hydrogen getter mounted within the discharge arc tube wherein the hydrogen getter comprises a first layer of a hydrogen permeable material, a second layer of a hydrogen permeable material, and a layer of a getter material having a first side, a second side and an edge surface, wherein said layer of a getter material is sandwiched between said first and second layers of hydrogen permeable material with said first layer covering said first side, said second layer covering said second side and said edge surface having its side edge openly exposed to said fill within said arc tube.

2. A discharge lamp according to claim 1 wherein the discharge arc tube has an electrode structure including an electrode shank, the hydrogen getter comprises a disc having a central hole and the disc is mounted on, and substantially encircles, the electrode shank.

3. A discharge lamp according to claim 2 wherein the disc is a split disc and opposite ends of the split disc are splayed apart.

4. A discharge lamp according to claim 1, 2 or 3 wherein said getter material is titanium and said hydrogen permeable material is niobium.

5. A discharge lamp according to claim 1, 2 or 3 wherein said getter material is zirconium.

* * * * *